United States Patent [19]

Martin

[11] 4,211,376

[45] Jul. 8, 1980

[54] PORTABLE CABLE SPOOLER FOR WELLS

[76] Inventor: Lloyd E. Martin, 5418 Bridge Forrest Dr., Houston, Tex. 77088

[21] Appl. No.: 59,456

[22] Filed: Jul. 20, 1979

[51] Int. Cl.[2] ..... B65H 75/40

[52] U.S. Cl. ..... 242/86.5 R; 242/54 R

[58] Field of Search ..... 242/86.5 R, 86.2, 85, 242/129, 54 R; 254/166

[56] References Cited

U.S. PATENT DOCUMENTS

| | | | |
|---|---|---|---|
| 422,262 | 2/1890 | Stringer | 242/86.5 R |
| 2,326,556 | 8/1943 | Opsal | 242/54 R |
| 2,569,390 | 9/1951 | Sewell | 242/85 X |
| 2,650,771 | 9/1953 | Marion | 242/54 R |
| 3,103,322 | 9/1963 | Garner | 242/86.5 R |
| 3,544,031 | 12/1970 | White | 242/86.5 R |

*Primary Examiner*—Edward J. McCarthy
*Attorney, Agent, or Firm*—Neal J. Mosely

[57] ABSTRACT

A portable, skid-mounted, field-powered cable spooler for oil wells is provided which is easily moved from site to site and operated under field conditions. This apparatus is primarily designed for use in winding and unwinding electric cable (such as REDA cable) for positioning submersible pumps in oil wells. The apparatus is skid-mounted to permit transportation by truck or helicopter to field location. A diesel engine, or equivalent, powers a hydraulic pump to drive a reversible hydraulic motor turning the shaft supporting the cable spool. The cable spool is mounted on spaced, open top, trunnion bearings which permits easy changing of the spools.

8 Claims, 2 Drawing Figures

PORTABLE CABLE SPOOLER FOR WELLS

BACKGROUND OF THE INVENTION

Field of the Invention

This invention relates to a new and useful improvements in portable cable winding apparatus and more particularly, to portable equipment for winding and unwinding cable for cable-suspended pumps in wells.

Brief Description of the Prior Art

Sewell, U.S. Pat. No. 2,569,390, discloses a well logging apparatus which includes an electric motor driven cable reel.

Elder, U.S. Pat. No. 3,113, 739, discloses a cable winding apparatus for winding and unwinding wire for tow targers used in gunnery practice.

REDA (REDA Pump Company, div. of TRW, Inc.) discloses in its advertising literature a cable-suspended pumping system which lowers a pump into an oil well on a cable and controls the raising and lowering of the pump to different levels. In the REDA cable suspended pump system the cable winding apparatus is quite intricate and expensive and is not easily portable from site to site.

Statement of Objects

One of the objects of this invention is to provide a new and improved portable field-powered cable spooler for oil wells and the like.

Another object of this invention is to provide an improved portable field-powered cable spooler movable on a supporting skid and having an improved hydraulic motor driven system for winding and unwinding.

Still another object of this invention is to provide a new and improved portable, field-powered cable spooler for oil wells which is skid-supported and driven by a hydraulic motor and provided with a bearing structure which permits easy changing of cable spool.

Still another object of this invention is to provide a new and improved portable, field-powered cable spooler for oil wells having a reversible and variable speed hydraulic motor system operated by a gasoline or diesel-powered engine integral therewith.

Other objects of this invention will become apparent from time to time throughout the specification and claims as hereinafter related.

SUMMARY OF THE INVENTION

The aforementioned objectives and other objects are achieved by the cable spooler apparatus constituting a preferred embodiment of this invention.

A portable, skid-mounted, field-powered cable spooler for oil wells is provided which is easily moved from site to site and operated under field conditions. This apparatus is primarily designed for use in winding and unwinding electric cable (such as REDA cable) for positioning submersible pumps in oil wells. The apparatus is skid mounted to permit transportation by truck or helicopter to field location. A diesel engine, or equivalent, powers a hydraulic pump to drive a reversible hydraulic motor turning the shaft supporting the cable spool. The cable spool is mounted on spaced, open top, trunnion bearings which permits easy changing of the spools.

DESCRIPTION OF THE PREFERRED EMBODIMENT

Figure 1:
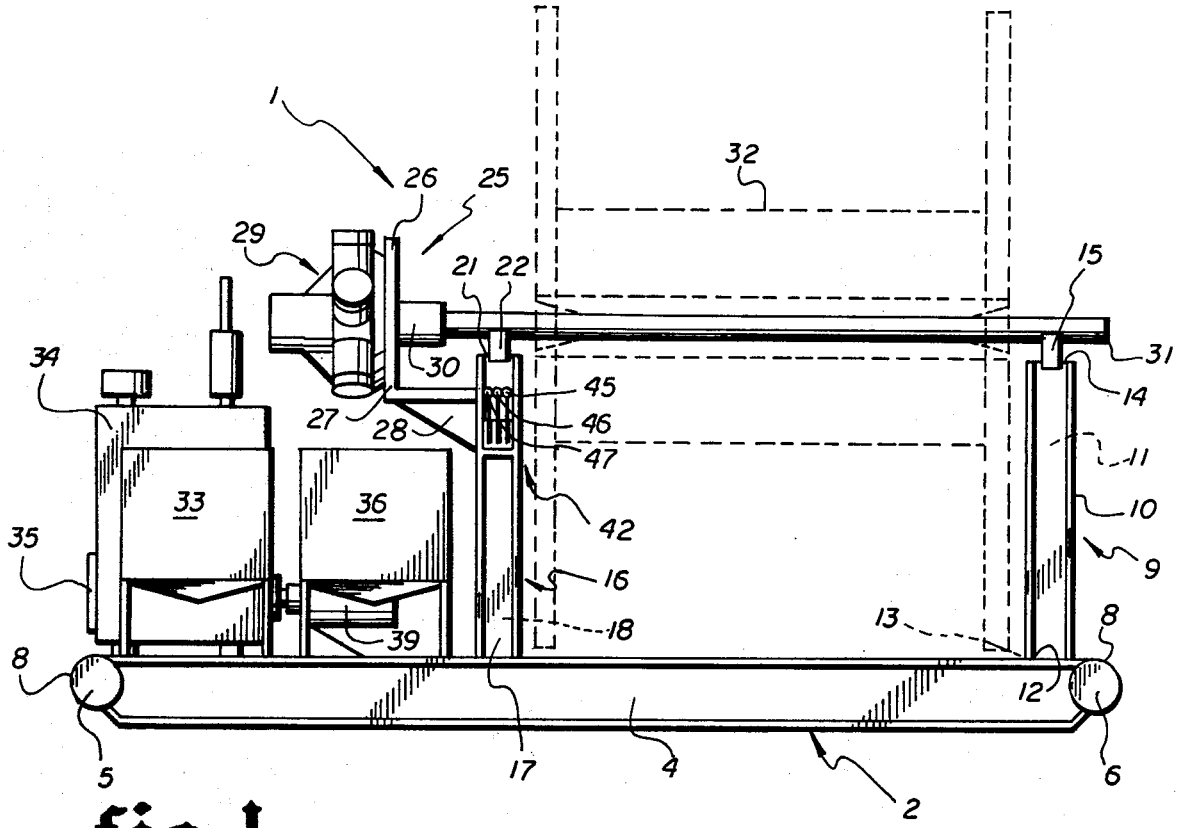
FIG. 1 is a view in side elevation of a preferred embodiment of the portable, field-powered cable spooler comprising this invention.
Figure 2:
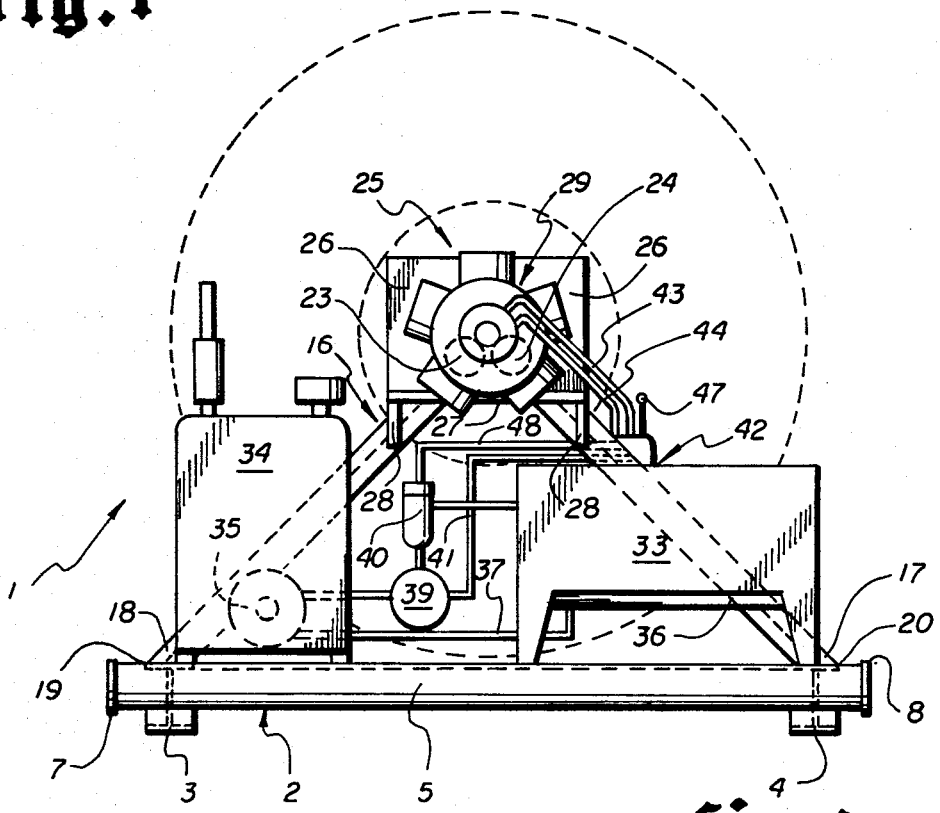
FIG. 2 is a view in left end elevation of the embodiment of the invention shown in FIG. 1.

Referring to the drawings by numerals of reference, there is shown a portable, field-powered cable spooler 1 which includes a supporting skid 2. Skid 2 comprises a rectangular framework consisting of structural steel members 3 and 4 secured to structural steel members 5 and 6 as a rectangular supporting skid. The supporting structural steel members are preferably of I-beam or H-beam construction or may be of angle iron or the like. Laterally extending structural support members 5 and 6 include end portions 7 and 8 which extend beyond the sides of the skid to provide support means for lifting the skid and the cable spooler supported thereon for moving the same from site to site in field operations. The laterally extending portions 7 and 8 provide for cable lifting of the apparatus for loading on trucks or for transporting to and from a well site by helicopter. Laterally extending supporting members 5 and 6 may be of tubular steel or steel rod, if desired. The supporting skid is secured together by welding of the respective structural pipes thereof.

At one end of skid 2, there is provided a vertically extending support 9 consisting of a pair of support members 10 and 11 which are secured to skid member 4 at 12 and to skid member 3 at 13 by welding. Members 10 and 11 are disposed angularly and are joined by welding as at 14 and support an open-top trunnion bearing assembly 15.

A second vertically extending support 16 is provided on skid member 2 in longitudinally spaced relation to support 9. Support 16 comprises a pair of support member 17 and 18 which are secured to skid member 3 and to skid member 4 by welding as indicated at 19 and 20. Support members 17 and 18 are disposed in an angular direction and are joined at their top by welding, as shown at 21. Support members 17 and 18 provide a support for open top trunnion bearing assembly 22 which comprises a pair of roller bearings 23 and 24 adapted to received and support the axle for supporting a cable spool. Trunnion bearing 15 is comprised of a pair of roller bearings in the same manner as trunnion bearing 22. Support members 10 and 11 and support members 17 and 18 are preferably of I-beam or H-beam construction or the like to provide rigidity.

Support member 16 is provided with supporting member 25 which has a vertically extending portion 26 and horizontally extending portion 27 and supporting ribs 28. Supporting member 25 is secured to support 16 by welding of supporting plates 27 and supporting ribs 28 to support members 17 and 18, respectively. Support member 25 has a reversible, adjustable speed hydraulic motor 29 secured thereon having a coupling 30 which releasably secures shaft 31 for supporting an electric cable spool 32. Shaft 31 is removable from coupling 30 and is removably supported on open top trunnion bearing 15 and 22.

Skid 2 supports the operating structure for the hydraulic motor 29 at the end adjacent, thereto. The operating structure comprises fuel tank 33 which supplies fuel to diesel motor 34 which, in turn, drives hydraulic pump 35. Hydraulic fluid tank 36 contains hydraulic fluid which is supplied to hydraulic pump 35 and to hydraulic motor 39 through a hydraulic circuit, to be subsequently described. Hydraulic fluid tank 36 is connected by conduit 37 to one side of hydraulic motor 35. The other side of hydraulic motor 35 is connected by conduit 38 to pressure regulator 39 and to filter 40. Pressure regulator 39 is connected by conduit 41 to control unit 42 which includes a pair of valves which control hydraulic fluid to one side or the other of hydraulic motor 29 for rotating said motor in one direction or the other. Control unit 42 also includes a control valve for controlling the rate of flow of hydraulic fluid for varying the speed of hydraulic motor 29.

Control unit 42 is connected by conduit 43 to one side of hydraulic motor 29 and by conduit 44 to the other side of the hydraulic motor. Flow of hydraulic fluid through these conduits is controlled by control valves (not shown) operated by control handles 45 and 46, respectively. Control handle 47 operates the control valve (not shown) which controls the rate of flow of hydraulic fluid and meters the flow to a conduit 48 extending to filter 40 and conduit 49 which extends back to hydraulic fluid supply tank 36.

OPERATION

The equipment described above is a portable, skid-mounted, field-powered cable spooler for use in winding and unwinding electric cable for oil wells. The equipment is compact and light enough to be carried by truck or by helicopter and is lifted by cables attached to extensions 7 and 8 on support members 5 and 6. The equipment is designed to handle massive electric cable spools of the type used in oil field operation. A typical cable spool may be 63 inches wide and have a diameter of 84 inches. Such a spool may contain 6,200 feet of wire cable and may weigh 18,000 pounds.

The cable spooler is run by diesel engine 34 which drives hydraulic pump 35 to operate hydraulic motor 29 which drives the supporting shaft 31 for a REDA cable spool. The equipment is preferably designed so that the flow of hydraulic fluid to motor 29 may be metered by control valves 47 to vary the speed from 0 to 50 RPM. The control valves operated by control handles 45 and 46 control the application of hydraulic fluid to one side or the other of hydraulic motor 29 to cause said motor to rotate in either direction, as desired. The hydraulic control valves control the application of hydraulic fluid to make the spool revolve in either direction at speeds from 0 to 50 RPM and are capable of stopping rotation of the spool if desired. The equipment is provided with filters 40 and pressure regulator 39 for safety. The hydraulic fluid supply tank 36 is constructed with easy access for cleaning. The arrangement shown, which utilizes open top trunnion bearings to support supporting shaft 31 for cable spool 32 makes it possible to handle spools that have been bent or warped, as well as spools that are in good condition. Once the spool is mounted in place, there are no further adjustments required. The equipment is capable of handling spools of a variety of size and spools can be changed during use, if desired. While this invention has been described fully and completely with special emphasis upon a single preferred embodiment, it should be understood that within the scope of the appended claims, the invention may be practiced otherwise than as specifically described herein.

I claim:

1. A portable, field-powered cable spooler for oil wells comprising a supporting skid comprising a rectangular framework constructed of structural steel members joined in rectangular form and including laterally extending support members at each end extending beyond the sides of said skid with end portions adapted to be secured by lifting apparatus for transporting the same, a pair of vertically extending supports extending from and secured on said skid in longitudinally spaced relation thereon, open-top trunnion bearings supported on said supports, a support member secured on one of said supports adjacent to the trunnion bearing thereon, a hydraulic motor supported on said support member, an axle member adapted to support and drive a well cable spool for feeding and winding power cable, said axle member being removably supported in and operated by said hydraulic motor and supported on said trunnion bearings, a hydraulic pump supported on said skid and hydraulically connected to said hydraulic motor for reversibly driving the same, and motor means supported on said skid and operatively connected to said pump to drive the same to operate said hydraulic motor to rotate a cable spool supported on said axle.

2. A cable spooler according to claim 1 in which said vertically extending supports each comprise a pair of vertically and angularly disposed support members having one end secured on the longitudinally extending structural members of said skid and the other end joined to an adjacent support member, and said trunnion bearings being supported on said support members adjacent to the point of joining said members.

3. A cable spooler according to claim 2 in which said hydraulic motor includes a coupling removably supporting said cable-spool supporting axle.

4. A cable spooler according to claim 2 in which control valve means is provided in the hydraulic connecting from said hydraulic pump to said hydraulic motor.

5. A cable spooler according to claim 4 in which said control valve means includes a first valve controlling flow of hydraulic fluid to said hydraulic motor in the forward direction, a second valve controlling flow of hydraulic fluid to said hydraulic motor in the reverse direction, and a third valve controlling the rate of flow of hydraulic fluid.

6. A cable spooler according to claim 5 in which said motor means comprises an internal combustion engine supported on and secured to said skid.

7. A cable spooler according to claim 6 including a tank for liquid fuel supported on and secured to said skid, and a tank for hydraulic fluid supported on and secured to said skid and hydraulically connected to said hydraulic pump and said hydraulic motor.

8. A cable spooler according to claim 7 including a pressure regulator and fluid filter connected in hydraulic circuit with said hydraulic motor.

* * * * *